US005481879A

United States Patent [19]

Asami et al.

[11] Patent Number: 5,481,879

[45] Date of Patent: Jan. 9, 1996

[54] REFRIGERATOR HAVING REGENERATOR

[75] Inventors: Hiroshi Asami, Yokohama; Mitsuru Suzuki, Hiratsuka, both of Japan

[73] Assignee: Sumitomo Heavy Industries, Ltd., Tokyo, Japan

[21] Appl. No.: 267,775

[22] Filed: Jun. 28, 1994

[30] Foreign Application Priority Data

May 31, 1994 [JP] Japan ..... 6-118165

[51] Int. Cl.[6] ..... F25B 9/00

[52] U.S. Cl. ..... 62/6; 60/520; 92/174

[58] Field of Search ..... 62/6; 60/520; 92/174

[56] References Cited

U.S. PATENT DOCUMENTS

| | | | |
|---|---|---|---|
| 3,292,501 | 12/1966 | Verbeek | 62/6 |
| 3,364,675 | 1/1968 | Dorer | 62/6 |
| 3,396,976 | 8/1968 | Reinhoudt et al. | 92/174 |
| 3,413,802 | 12/1968 | Cowans | 62/6 |

*Primary Examiner*—Ronald C. Capossela

*Attorney, Agent, or Firm*—Frishauf, Holtz, Goodman, Langer & Chick

[57] ABSTRACT

A refrigerator with a regenerator having a good and stable cooling function comprises: a cylinder having a circular inner surface and being made of a material having a low heat conductivity and a high hermetic sealing performance; a displacer having a circular outer surface having a slightly smaller diameter than the inner surface of the cylinder, forming a main gas passage there through, and containing regeneration material therein, the displacer being disposed in the cylinder to be reciprocally movable in the axial direction the cylinder and forming an expansion space at one end of the cylinder; a groove pattern formed on one of the outer surface of the displacer and the inner surface of the cylinder, for forming an auxiliary gas passage for supplying gas into and recovering the gas from the expansion space, the groove pattern including a groove at least partially formed along the direction intersecting the axial direction of the displacer, such as a helical groove, the groove allowing a gas flowing through a gap between the cylinder and the displacer from one end to the other end of the displacer to positively heat-exchange with the cylinder and the displacer.

32 Claims, 12 Drawing Sheets

REFRIGERATOR HAVING REGENERATOR

BACKGROUND OF THE INVENTION a) Field of the Invention

The present invention relates to a refrigerator, particularly a refrigerator using gas coolant such as helium and having a regenerator accommodating regenerating material.

b) Description of the Related Art

As a refrigerator using gas coolant such as helium and having a regenerator accommodating regenerating material, there are known a Gifford-McMahon (GM) cycle refrigerator, a (reverse) Stirling cycle refrigerator, and the like. A refrigerator will be described taking a Gifford-McMahon (GM) refrigerator as an example which is intended not to be limitative. A GM refrigerator cools helium gas supplied from a helium gas compressor via a gas passage controlled by a valve, by expanding the gas in an expansion space. An extremely low temperature is generally obtained by using a plurality of cooling stages. A Joule-Thomson (JT) valve mechanism may be used with the GM refrigerator.

A cryopump is used for obtaining clean vacuum in a sputtering system for manufacturing semiconductor devices. Recently, a GM refrigerator has been used as a cryopump type refrigerator. Not only as a cryopump, a GM refrigerator can be used for various purposes.

FIG. 2 is a schematic diagram showing an example of the structure of a GM refrigerator. This structure is made of two stages suitable for obtaining an extremely low temperature of about several K. to 20 K.

A helium gas compressor 10 compresses helium gas to about 20 Kgf/cm$^2$ and supplies high pressure helium gas. This high pressure helium gas is supplied yo the inside of a first stage cylinder 11 via an intake valve V1 and a gas passage 16. The first stage cylinder 11 is coupled to a second stage cylinder 12.

First and second displacers 13 and 14 integrally formed are housed in the first and second stage cylinders 11 and 12. A shaft S extends upward from the first displacer 13, and is coupled to a crank mechanism 15 which is coupled to a driver motor M.

The first and second displacers 13 and 14 each have a hollow space for accommodating regenerating material. The first and second displacers 13 arid 14 are formed with gas passages 23 and 24 which communicate with the outside spaces.

Expansion spaces 21 and 22 are defined by, and formed between, the first displacer 13 and the first stage cylinder 11, and between the second displacer 14 and the second cylinder 12.

The first and second stage cylinders 11 and 12 are made of, for example, stainless steel (e.g., SUS 304) having a sufficient strength, a low heat conductivity, arid a sufficient shielding ability of helium gas.

The first and second displacers 13 and 14 are made of, for example, phenol (bakelite) containing cloth having a small specific gravity, a sufficient abrasion proof, a relatively high strength, and a low heat conductivity.

The high pressure helium gas supplied from the helium gas compressor 10 via the intake valve V1 is supplied to the inside of the first stage cylinder 11 via the gas passage 16, and to the first stage expansion space 21 via a gas passage 23*a*, a first stage regenerating material 17 such as a copper wire screen, and a gas passage 23*b*.

The compressed helium gas in the first stage expansion space 21 is supplied to the second stage expansion space 22 via a gas passage 24*a*, a second stage regenerating material 18 such as lead balls, and a gas passage 24*b*. The gas passages 23 and 24 are functionally shown in FIG. 2, and the real structure thereof is different.

When the intake valve V1 is closed and an exhaust valve V2 is opened, the high pressure helium gas in the second and first state cylinders 12 and 11 is recovered back to the helium gas compressor 10 via the flow route opposite to the intake passages, and via the gas passage 16 and the exhaust valve V2.

In operation of the GM refrigerator, the driver motor M rotates so that the first and second displacers 13 and 14 are reciprocally moved up and down as indicated by a double-headed arrow in FIG. 2. While the first and second displacers are driven downward, the intake valve V1 is opened so that the high pressure helium gas is supplied to the inside of the first and second cylinders 11 and 12.

While the first and second displacers 13 and 14 are driven upward by the driver motor M, the intake valve V1 is closed and the exhaust valve V2 is opened so that the helium gas is recovered into the helium gas compressor 10 and the expansion spaces in the first and second stage cylinders 11 and 12 lower their pressures.

At this time, the helium gas in the expansion spaces 21 and 22 are expanded and cooled. The cooled helium gas cools the regenerating materials 18 and 17.

At the next intake cycle, the supplied high pressure helium gas is cooled while it passes through the regenerating materials 17 and 18. The cooled helium gas is expanded and cooled further. At the steady state, the expansion space 21 in the first stage cylinder 11 is maintained at a temperature of, for example, 40 K. to 70 K., and the expansion space 22 in the second stage cylinder 12 is maintained at a temperature of several K. to 20 K.

A first stage heat station 19 surrounds the lower portion of the first stage cylinder 11 and thermally couples thereto, whereas a second stage heat station 20 surrounds the lower portion of the second stage cylinder 12 and thermally couples thereto.

The first heat station 19 is coupled, for example, to the panel of a cryopump to adsorb gas molecules. The second heat station 20 is coupled, for example, to an adsorption panel accommodating adsorbent such as activated carbon, to adsorb residual gas molecules. A cryopump having such a structure is used when a sputtering system or the like requires generation of a clean vacuum.

In the GM refrigerator constructed as above, it is designed to supply the gas in the upper portion of a cylinder to the lower portion of the cylinder. In order to prevent helium gas from passing through a gap between a displacer and a cylinder, a seal mechanism is provided between a displacer and a cylinder.

Although not shown in FIG. 2, a seal ring is inserted between the first stage displacer 13 and first stage cylinder 11 to provide the first stage cylinder 11 with a seal mechanism. Similarly, a seal ring is inserted between the second stage displacer 14 and second stage cylinder 12 to provide the second stage cylinder 12 with a seal mechanism.

FIGS. 9A and 9B show an example of the, second stage displacer. As shown in FIG. 9A, a tubular member 80 of a circular shape in section is made of phenol resin containing cloth, and formed with a groove 81 at its outer periphery in a circumferential direction. A seal ring is inserted in the groove 81. Openings 82 forming a gas passage are formed in the lower wall of the tubular member 80.

A lid 83 made of phenol resin containing cloth is inserted in the tubular member 80 at, its bottom, and bonded thereto. The lid 83 is a blank lid, and hermetically seals the bottom opening of the tubular member 80. The lid 83 may be made of material other than the phenol resin containing cloth. It is preferable to use material having a small specific gravity in view of easy motion of the displacer.

The upper surface of the lid 83 is slightly lower than the gas passage 82 to dispose a wire screen 84 on the upper surface of the lid 83. The height of the wire screen 84 is flush with the openings 82. The outer diameter of the tubular member 80 at the position lower than the openings 82 is slightly smaller than the outer diameter at the position higher than the openings 82. Therefore, a gap is formed between the outer circumference of the tubular member 80 and the inner circumference of the cylinder. This gap is a gas passage communicating the inside of the tubular member 80 with the expansion space 22 shown in FIG. 2.

A felt plug 85 is disposed on the wire screen 84, and the regenerating material 18 such as lead balls is filled in the inner space of the tubular member 80. Another felt plug 86 is disposed on the regenerating material 18, and a punched metal plate 87 is disposed on the felt plug 86.

A coupling mechanism 88 for coupling the tubular member 80 to the first stage displacer is inserted into the tubular member 80 and mounted above the punched metal 87. The coupling mechanism 88 is made of Al or Al alloy.

FIG. 9B shows the structure of a seal ring disposed between the tubular member 80 and cylinder 12. An expander ring 89 is inserted into the groove 81 of the tubular member 80 and a piston ring 90 is inserted into the groove 81 over the expander ring 89.

FIGS. 10A and 10B show an example of the structure of the first stage displacer. As shown in FIG. 10A, a tubular member 100 of a circular shape in section made of phenol resin containing cloth has an upper lid. An opening 101 forming a gas passage is formed in the upper lid of the tubular member 100. A circumferential step 102 for accommodating a seal ring is formed at the periphery of the upper plane of the tubular member 100.

As shown in FIG. 10B, an O ring 103 and a slipper seal 104 are filled in the circumferential step 102. The O ring 103 and slipper seal 104 are fixed by a flange 105 mounted on the upper plane of the tubular member 100 by a bolt. The outer periphery of the slipper seal 104 slightly projects from the outer periphery of the tubular member 100, and contacts the inner surface of the first stage cylinder 11.

As shown in FIG. 10A, a drive shaft S for moving the tubular member 100 up and down in the direction indicated by a double-headed arrow is formed on the upper plane of the flange 105.

A wire screen 106 is provided contacting the top of the inner space. Regenerating material 17 such as a copper wire screen is filled in the inner space the tubular member 100 under the wire screen 106. Another wire screen 107 is disposed under the regenerating material 17. Openings 108 forming a gas passage are formed in the side wall of the tubular member 100 at the height of the wire screen 107.

A lid 109 made of phenol, resin containing cloth is inserted into the tubular member 100 under the wire screen 107, and bonded to the tubular member 100. The lid 109 is a blank lid, and hermetically seals the bottom opening of the tubular member 100. A recess is formed on the bottom surface of the lid 109 to mount the coupling mechanism 88 shown in FIG. 9A.

The outer diameter of the tubular member 100 at the position lower than the openings 108 is set slightly smaller than the inner diameter of the cylinder. Therefore, a gap is formed between the inner circumference of the first stage cylinder 11 and the outer circumference of the tubular member 100 at the position lower than the openings 108. This gap forms a gas passage communicating the inside of the tubular member 100 with the expansion space 21 shown in FIG. 2.

In the refrigerator with a regenerator described above, a cooled temperature becomes higher than a designed temperature in some cases, or a temperature change becomes large in other cases.

A predetermined cooling performance is obtained in some cases by disassembling the refrigerator arid replacing the seal ring (e.g., a combination of the expander ring 89 and piston ring 90 shown in FIG. 9B disposed between the second stage displacer 14 and second stage cylinder 12 of the structure shown in FIG. 2) between the displacer and cylinder disposed at a low temperature area by a new seal ring. It can be presumed from such experiences that a cooling performance is greatly influenced by a seal mechanism between the displacer and cylinder.

SUMMARY OF THE INVENTION

It is an object of the present invention to provide a refrigerator with a regenerator having a good and stable cooling performance.

According to one aspect of the present invention, a refrigerator having a regenerator is provided. The refrigerator includes: a cylinder having a tubular inner circumferential surface, the cylinder being made of a material having a low heat conductivity and a high hermetic sealing performance; a displacer having a tubular outer circumferential surface having a slightly smaller diameter than the inner circumferential surface of the cylinder, the displacer being disposed in the cylinder reciprocally to be reciprocally movable in the axial direction of the cylinder and forming an expansion space near one end of the inside of the cylinder; a groove pattern formed on the outer circumferential surface of the displacer for forming an auxiliary gas passage interconnecting one and the other end of the outer circumferential surface, the groove pattern including a groove at least partially formed along the direction intersecting the axial direction of the displacer, the groove allowing a gas flowing through a gap between the cylinder and the displacer from one end to the other end of the outer circumferential surface of the displacer to positively heat-exchange with the cylinder and the displacer; a main gas passage for supplying a gas to the expansion space and recovering the gas from the expansion space; and regenerating material disposed at least partially in the main gas passage.

Gas diverted from the normal main gas passage having the regenerating material and flowing through the gap between the displacer and cylinder mainly flows along grooves of the groove pattern formed on the outer circumferential surface of the displacer. The grooves of the groove pattern are formed along the direction intersecting the axial direction of the displacer so as to allow the gas flowing through the grooves to positively heat-exchange with the displacer and cylinder.

Therefore, diverted gas flowing from the high temperature side to the low temperature side is cooled more than the gas directly flowing in the axial direction. Conversely, diverted gas flowing from the low temperature side to the high temperature side cools the displacer and cylinder more than the gas directly flowing in the axial direction. As a result, a heat loss by diverted gas can be reduced.

It is not necessary to mount a sealing member between the displacer and cylinder. Therefore, it is possible to prevent the cooling performance from being lowered by incomplete sealing and to avoid an unstable cooled temperature.

As described above, the cooling performance of a refrigerator with a regenerator can be improved.

Furthermore, it is possible to provide a refrigerator with a regenerator with which it is not necessary to use a seal mechanism posing an abrasion problem and shortening a life time and having a small number of components, thereby simplifying assembly and maintenance. Still further, a regenerating material accommodating space can be increased so that the cooling performance can be improved.

DETAILED DESCRIPTION OF THE PREFERRED EMBODIMENTS

Figure 1:
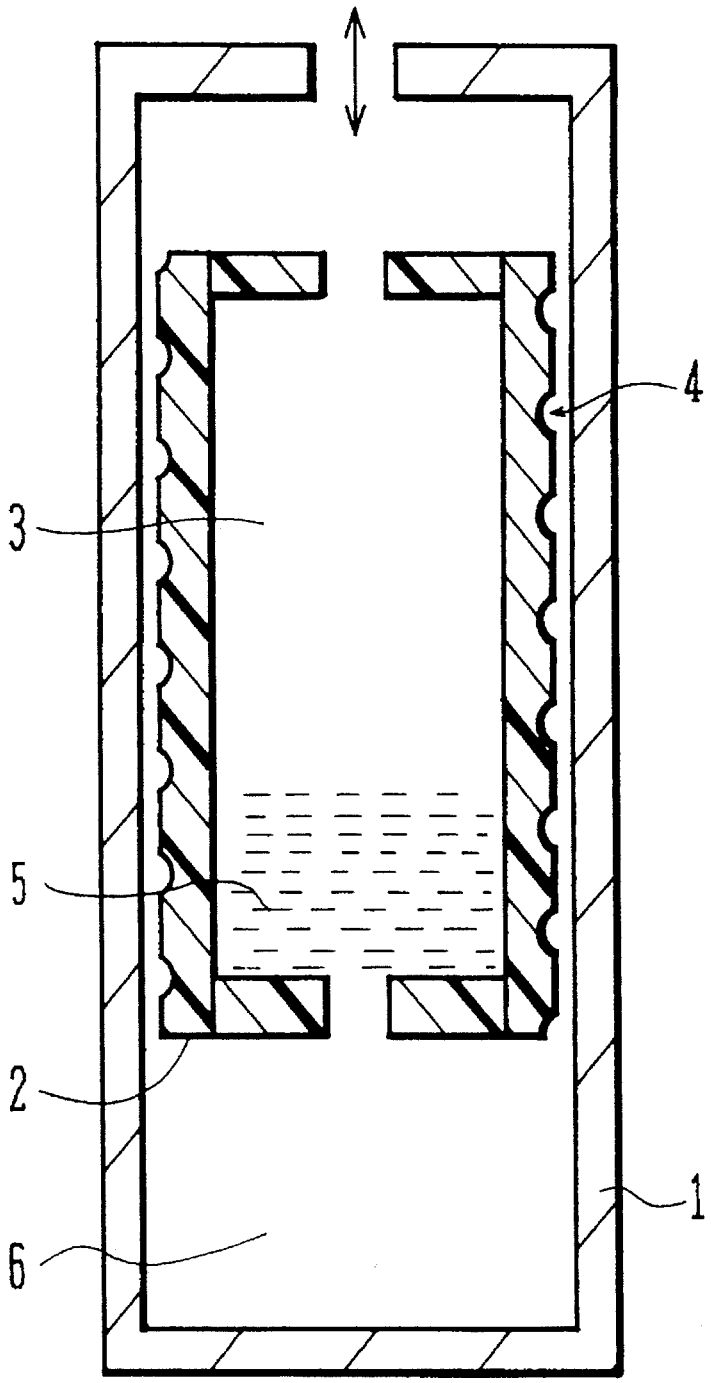
FIG. 1 is a cross sectional view showing the fundamental structure of a refrigerator with a regenerator according to an embodiment of the present invention.

FIG. 1 shows the fundamental structure of a refrigerator with a regenerator according to an embodiment of the invention. A cylinder 1 is made off rigid material such as stainless steel having a low heat conductivity and a high hermetic sealing performance. A tubular displacer 2 off a circular shape in section is disposed at the inside of the cylinder 1. A spiral gas passage 4 is formed on the outer circumferential surface of the displacer 2. The spiral or helical gas passage 4 is formed by one or a plurality of spiral grooves interconnecting the upper and lower ends of the displacer 2.

The displacer 2 has a hollow space therein to form a gas passage 3. Regenerating material 5 having a large heat capacity at the operating temperature is filled in the gas passage 3. An expansion space 6 is defined by, and formed between, the displacer and the bottom of the cylinder 1.

Coolant gas from the upper portion is supplied via the gas passage 3 in the displacer 2 into the expansion space 6. The coolant gas is partially diverted from the gas passage 3 and flows through a gap between the displacer 2 and cylinder 1. The diverted gas passes through the spiral gas passage 4 formed on the outer circumferential surface of the displacer 2 while heat-exchanging with the surfaces of the displacer 2 and cylinder 1, and flows downward to the expansion space 6. The coolant gas is cooled by expansion. As the cooled gas is recovered to the upper portion, it flows through the gas passage 3 while cooling the regenerating material 5. In this case, similar to the above, the cooled gas is partially diverted and flows upward along the spiral gas passage 4 while heat-exchanging with the surfaces of the displacer 2 and cylinder 1, and is combined with the coolant gas passed through the gas passage 3.

The coolant gas flowing through the spiral gas passage 4 thermally contacts the surfaces off the displacer 2 and cylinder 1 for a longer time than the case where coolant gas flows straight forward in the axial direction through the gap between the displacer 2 and cylinder 1. As a result, a great amount of heat exchange can be performed between the coolant gas and the gas passage surfaces.

In a conventional refrigerator with a regenerator, a seal ring has been used for reducing the amount off coolant gas flowing through the gap between the displacer and cylinder. However, it is very difficult to realize a high sealing performance, resulting in an unstable sealing performance, a less cooled temperature, and a temperature change.

In this embodiment, it is not necessary to use a seal ring at the low temperature area, thereby being free from the above-described deterioration. Embodiments of the invention will be described by using a two-stage type GM refrigerator schematically shown in FIG. 2. The GM refrigerator shown in FIG. 2 has been described already, and so the explanation thereof is omitted.

Figure 2:
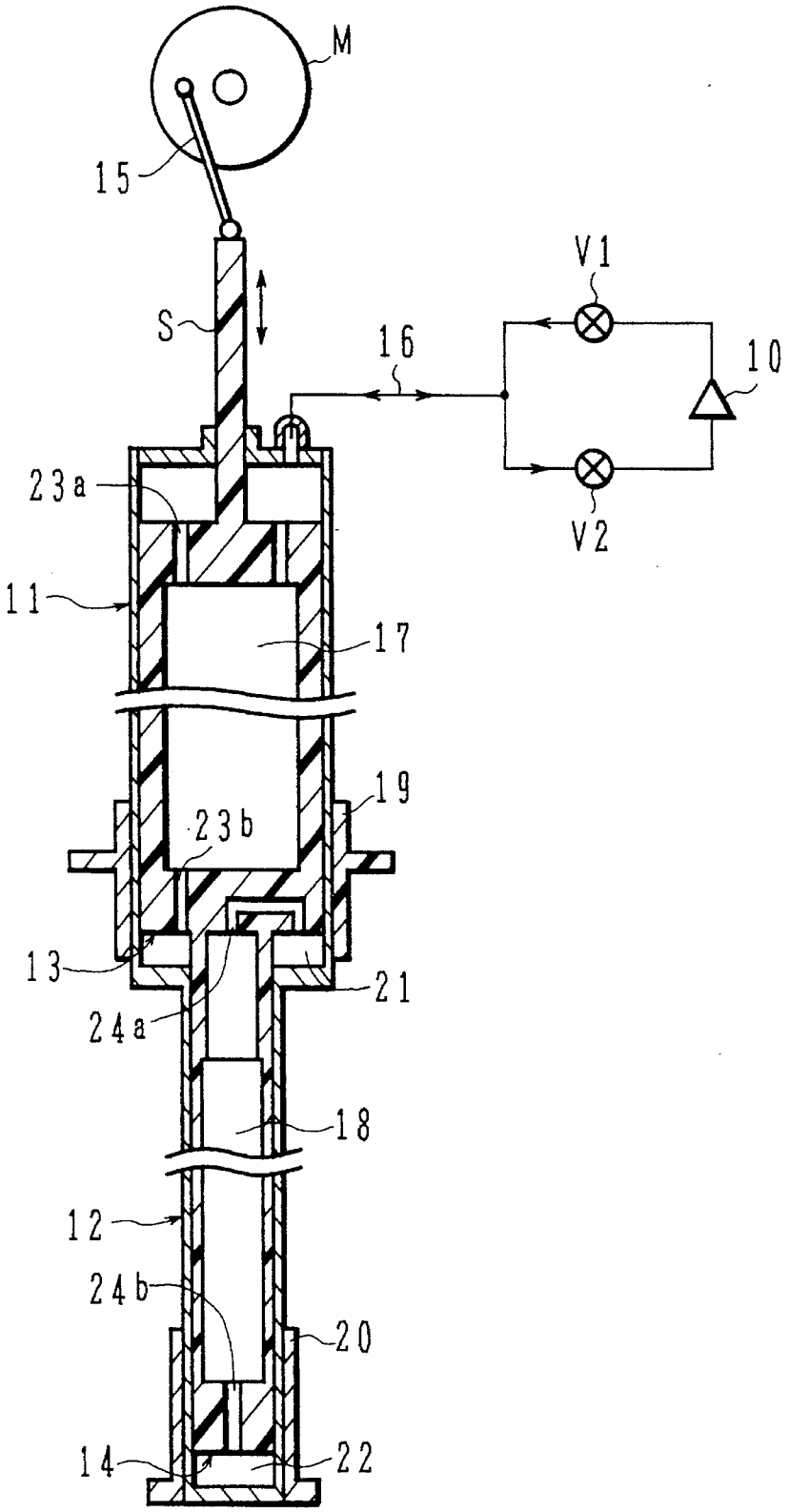
FIG. 2 is a schematic cross sectional view showing the structure of a two-stage type GM refrigerator.
Figure 3:
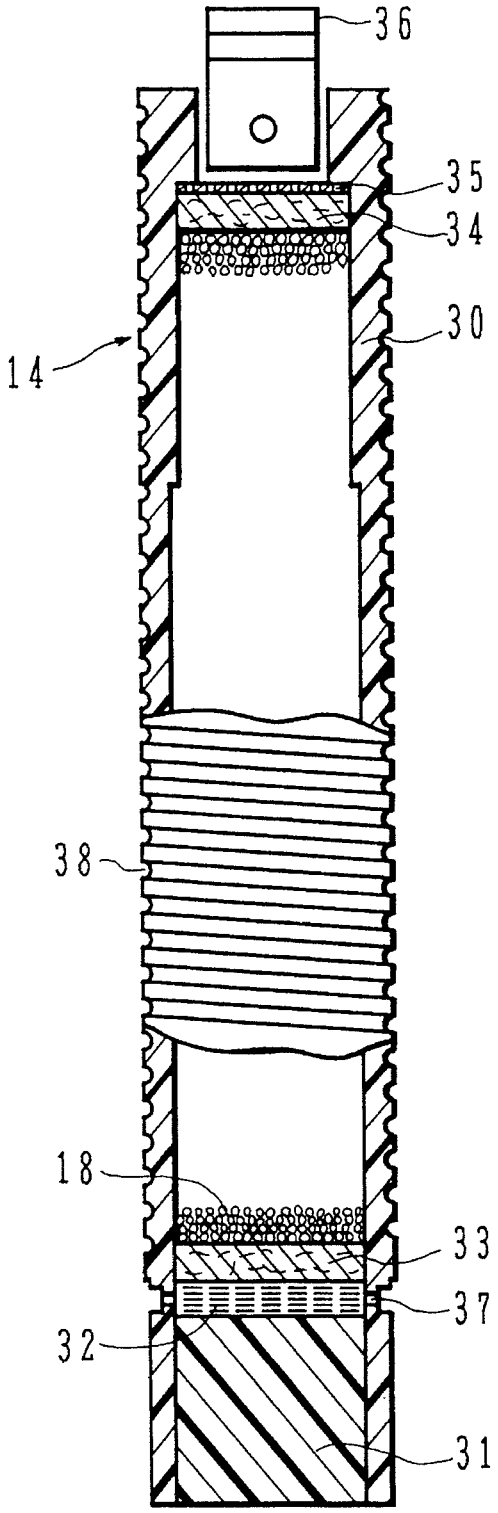
FIG. 3 is a cross sectional view showing an example of the structure of a second stage displacer off a refrigerator with a regenerator according to an embodiment of the present invention.

FIG. 3 shows the structure of the second stage displacer 14 of the two-stage type GM refrigerator shown in FIG. 2. A tubular member 30 of a circular shape in section made of phenol containing cloth has top and bottom openings. For example, if the inner diameter of the second stage cylinder shown in FIG. 2 is 35 mm, the outer diameter of the tubular member 30 is 35 mm and the inner diameter thereof is 30 mm. The length of the displacer in the axial direction is, for example, about 200 mm. A lid 31 made of, for example, phenol containing cloth is inserted into the tubular member 30 at the bottom thereof, and bonded to the tubular member 30. A wire screen 32 is disposed on the lid 30, and a felt plug 33 is disposed on the wire screen 32.

Regenerating material such as lead balls is filled the displacer 14 above the felt plug 33. Another felt plug 34 is disposed on the regenerating material 18. A punched metal plate 35 is disposed on the felt plug 34. The punched metal plate 35 is fixed to a step formed at the upper inner circumferential surface of the tubular member 30. A coupling mechanism 36 for coupling the second displacer 14 to the first displacer 13 shown in FIG. 2 is mounted on the top of the tubular member 30.

Openings 37 are formed in the side wall off the tubular member 30 at the height of the wire screen 32 to form a gas passage. A spiral gas passage 38 is formed on the outer circumferential surface off the tubular member 30 at the position higher than the openings 37, the spiral gas passage 38 being constructed of a single spiral groove interconnecting the side wall at the openings 37 and the top of the side wall. This groove has, for example, a width off about 2 mm, a depth of about 0.6 mm, and a pitch of about 4 mm.

The outer diameter of the tubular member 30 at the position lower than the openings 37 is slightly smaller than the outer diameter at the position higher than the openings 37. Therefore, a gap is formed between the tubular member 30 and the second stage cylinder at the position lower than the openings 37. This gap forms a gas passage communicating the inside of the tubular member 30 with the expansion space 22 shown in FIG. 2.

It is preferable that a gap between the outer circumferential surface of the tubular member 30 and the inner surface of the second stage cylinder 12 is 0.01 mm or larger to provide a stable reciprocal motion of the displacer, and is 0.03 mm or smaller to prevent a straight forward flow of the leakage gas in the axial direction.

The regenerating material 18 may be made of different materials. For example, magnetic regenerating material may be used to enhance the cooling performance.

Figure 4:
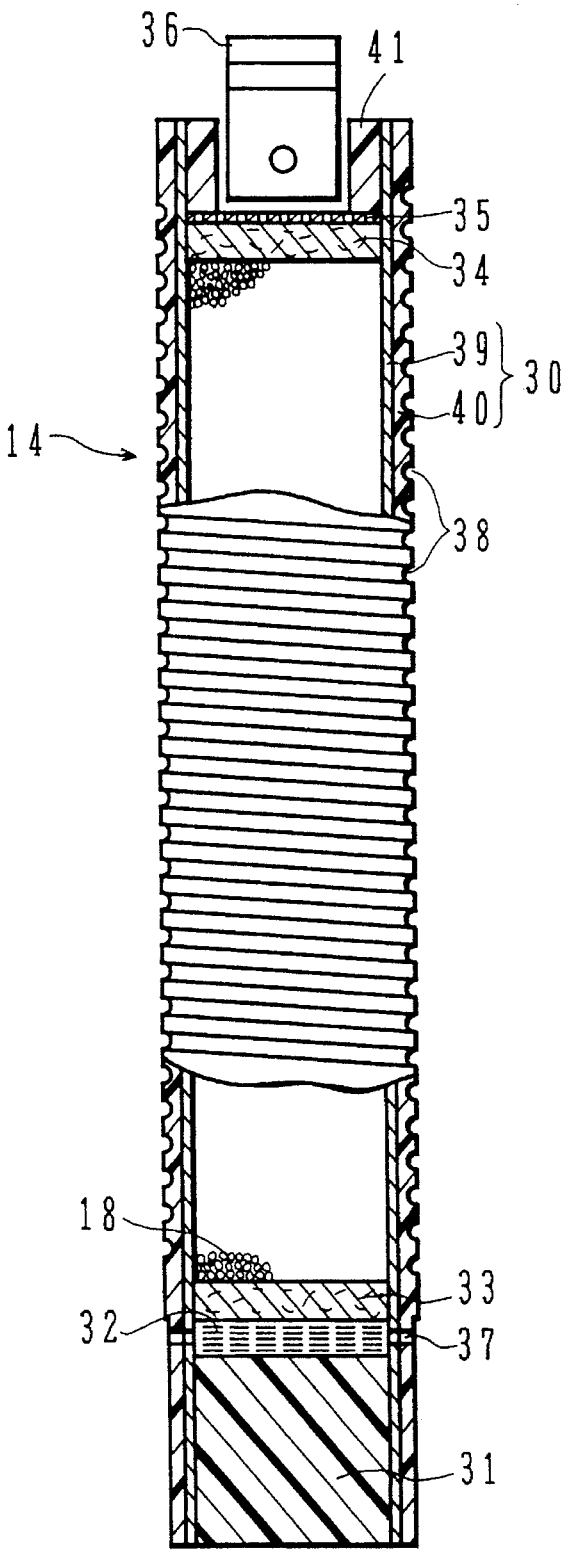
FIG. 4 is a cross sectional view showing another example of the structure of a second stage displacer of a refrigerator with a regenerator according to an embodiment of the present invention.

FIG. 4 shows another structure of the second stage displacer 14. The tubular member 30 of a circular shape in section has a stainless steel tube 39 and an anti-abrasion resin member 40 made off phenol containing cloth. The anti-abrasion resin member 40 is fixed to the surface of the stainless steel tube 39.

For example, the anti-abrasion resin member 40 has an outer diameter of 35 mm, an inner diameter of 32 mm, and the stainless steel tube 39 has an inner diameter of 30 mm. Provision of the stainless steer tube having a high mechanical strength at the inside off the tubular member 30 suppresses heat shrinkage off the anti-abrasion resin member 40 when it is cooled. As a result, the heat deformation characteristics of the stainless steel cylinder and the displacer become similar.

A ring lid 41 is inserted into the upper opening of the tubular member 30. The other structures are the same as the displacer shown in FIG. 3.

The structures of the displacers shown in FIGS. 3 and 4 are not necessary to provide a seal ring so that the thickness of the side wall of the tubular member 30 can be made thin.

This means that a space for accommodating regenerating material in the displacer can be increased. An increased quantity of the regenerating material results in an increase of the cooling ability. Since the seal ring is not necessary, it is possible to reduce the number of components, simplify the assembly process, and tower the manufacturing cost.

Figure 10A:
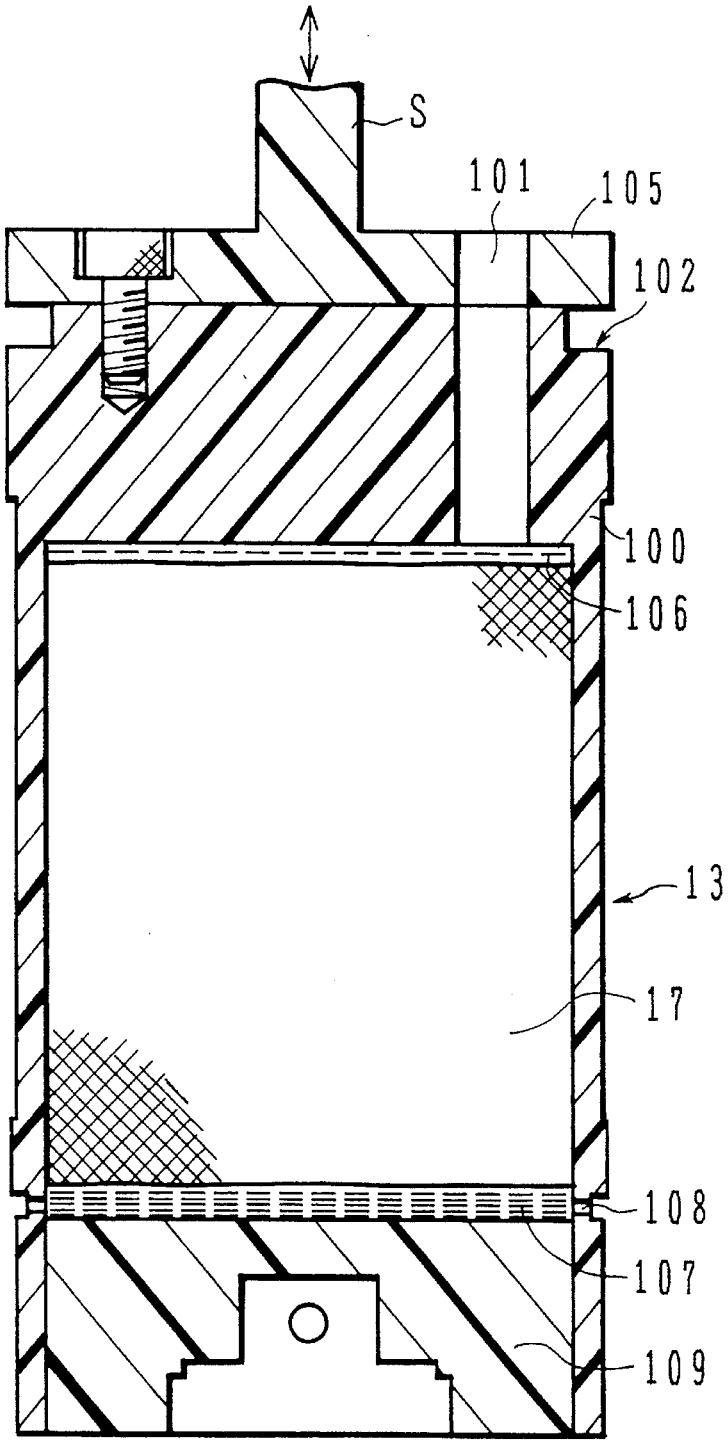
FIG. 10A is a cross sectional view of a conventional first stage displacer.
Figure 10B:
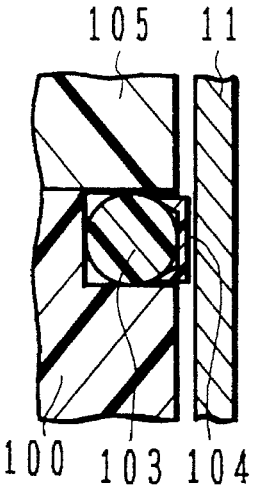
FIG. 10B is a cross sectional view showing a sealing mechanism of a conventional first stage displacer.

The cooling performance of a GM refrigerator having the structure shown in FIG. 2 constituted by the first stage displacer 13 of the conventional structure shown in FIG. 10 and the second stage displacer of the structure shown in FIG. 4 as well as the cooling performance of a GM refrigerator having the conventional structure shown in FIGS. 9A, 9B and 10A, 10B was measured. The stroke of the displacers was 30 mm, erbium-holmium-nickel (ErHoNi) magnetic regenerating material having a diameter of 0.2 to 0.5 mm was used, and the revolution speed of the driver motor was 60 rpm.

Figure 5:
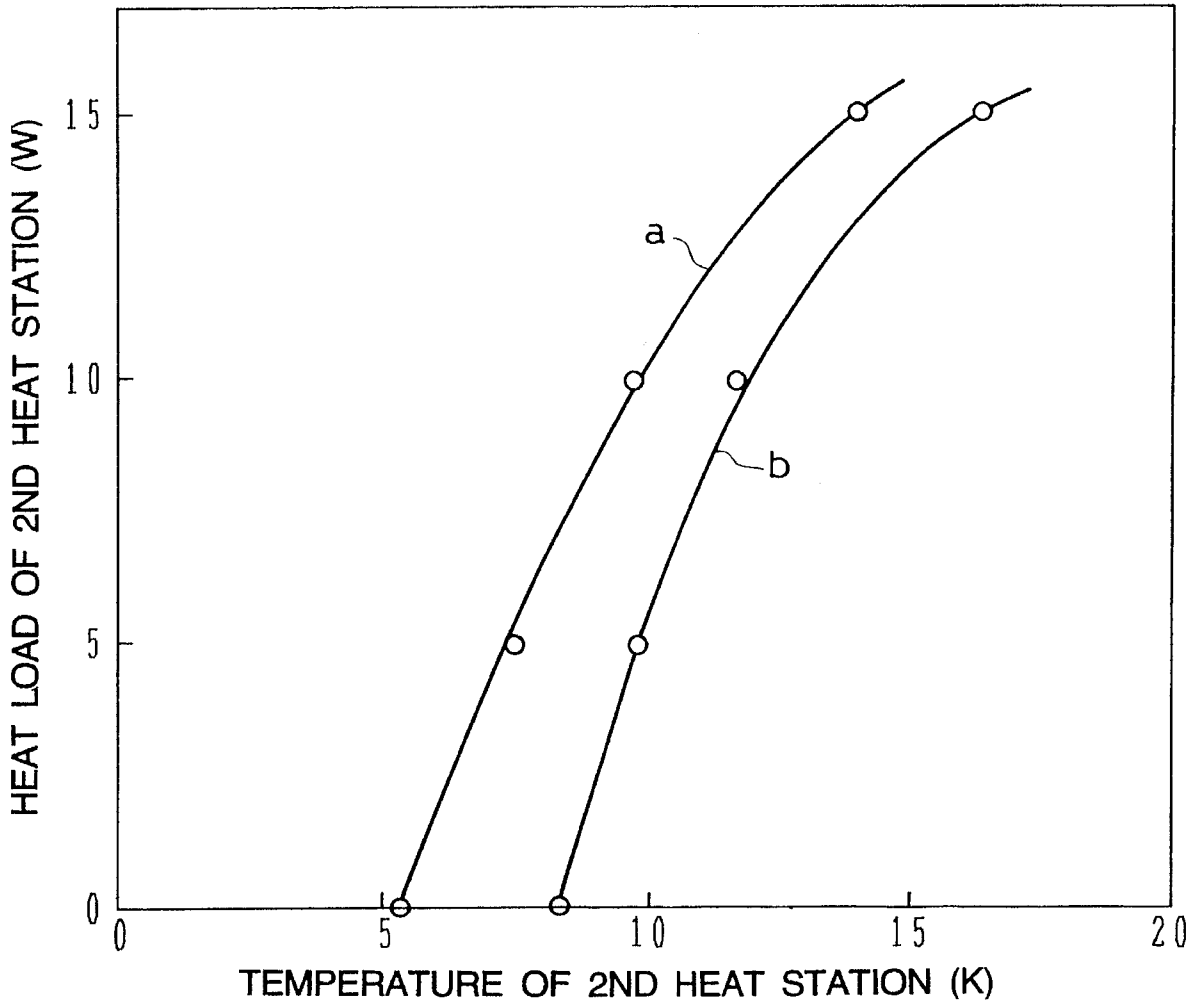
FIG. 5 is a graph showing the cooling performance of a refrigerator with a regenerator having a spiral groove formed on the second stage displacer, as compared to the cooling performance of a conventional refrigerator with a regenerator.

FIG. 5 shows the measurement results of a cooling test applying a heat load of 30 W to the first stage. The abscissa represents a temperature of the second heat station in units of K, and the ordinate represents a heat lead applied to the second heat station in units of W. The curve a represents the case where the displacer having the structure shown in FIG. 4 was used, and the curve b stands for the case where the conventional displacer having the structure shown in FIGS. 9A and 9B was used.

The lowest temperature obtained by using the conventional displacer was 8.4 K., whereas the lowest temperature obtained by using the displacer having the structure shown in FIG. 4 was 5.4 K. Although the temperature of both the second heat stations rose when a heat load was applied to the second heat station, the second heat station using the displacer having the structure shown in FIG. 4 was lower by about 2 to 3 K. Although a conventional GM refrigerator is resistant to a heat load of up to about 5 W, the GM refrigerator having the structure shown in FIG. 4 was resistant to a heat lead of up to about 10 W.

Use of the displacer having a spiral gas passage shown in FIG. 4 improved the cooling performance. Although not shown in the graph of FIG. 5, the temperature was also stabilized.

In the above embodiment, the width off a spiral groove is about 2 mm, the depth thereof is about 0.6 mm, and the pitch thereof is about 4 mm. A good cooling performance was also realized by using a spiral groove having a width of 2 to 3 mm, a depth of 0.6 to 0.7 mm, and a pitch of 3, 4, or 6 mm. It is conceivable that the same effect may be obtained by using a spiral groove having a width of 1 to 6 mm, a depth of 0.3 to 1.5 mm, and a pitch of 1.5 to 12 mm.

In order to verify the effects of a spiral groove, the cooling performance was compared between a GM refrigerator having a conventional displacer shown in FIG. 9 with the piston ring 90 and expander ring 89 being removed, and a GM refrigerator having a displacer of the structure shown in FIG. 3. As the regenerating material, ErHoNi magnetic regenerating material and lead particles having a weight ratio of 1 : 1 were used. A difference between both the GM refrigerators is only whether or not they have a spiral groove on the outer circumferential surface of the displacer.

The lowest temperature obtained was measured under the condition that the stroke of the displacer was 25 mm and the revolution speed was 60 rpm. The lowest temperature obtained by the displacer having the structure shown in FIG. 3 was 6.2 K., whereas the lowest temperature obtained by the conventional displacer shown in FIG. 9 without the piston ring 90 and expander ring 89 was 9.5 K. It is supposed that this difference results from a presence/absence of the spiral groove.

The cooling performance of the structure having a displacer with a spiral groove and a piston ring and expander ring was inferior to that of the structure having only a spiral groove. From this fact, it can be understood that it is better to flow a predetermined amount of gas through a gap between the displacer and cylinder and positively heat-exchange with the displacer and cylinder, than to stop a gas flow.

A conventional refrigerator with a regenerator uses a seal ring in order to reduce leakage gas flowing through a gap between the displacer and cylinder. During the gas suction cycle, this leakage gas having a high temperature at the upper stage does not flow into the regenerator but directly flows into a low temperature expansion space and raises its temperature. During the gas exhaust cycle, expanded gas having a low temperature directly moves to the high temperature area at the upper stage without cooling the regenerator. Therefore, leakage gas operates to considerably degrade the cooling performance.

The function of the seal ring is therefore very important. However, the sealing ring has technical issues difficult to be solved. The material of a seal ring is generally teflon resin. The teflon resin seal ring is hardened at a tow temperature regardless of the fact that the viscosity of coolant gas lowers and the gas is likely to leak. As a result, the sealing effect is greatly deteriorated at a temperature. Worse, a pressure difference between the upper and lower surfaces of a seal ring is reversed between the gas exhaust cycle and gas suction cycle, and the seal ring becomes likely to move in the groove because the displacer is driven up and down, resulting in an unstable sealing effect.

Even if a hermetic seal is perfect, gas moves up or down between the expansion space and seal ring via a gap between the displacer and cylinder at each gas suction/exhaust cycle. This gas does not heat-exchange with the regenerator like the above-described leakage gas, resulting in a heat loss.

With the embodiment displacer having a spiral groove formed on the outer circumferential surface thereof, gas diverted from the gas flowing in the normal gas passage and in the regenerating material flows through a gas passage formed by a gap between the inner surface of the cylinder and the outer circumferential surface of the displacer. This gas flowing through this gas passage contacts the surface of the gas passage and heat-exchanges with it. As a result, a heat loss can be reduced.

It is not necessary to mount a sealing member so that the cooled temperature is prevented from becoming unstable due to imperfect sealing. Furthermore, the life time of a sealing member can be prevented from being shortened due to abrasion thereof.

In the embodiments shown in FIGS. 3 to 5, the second stage displacer of a GM refrigerator shown in FIG. 2 is formed with a spiral gas passage. The spiral gas passage may be formed on the first stage displacer.

Figure 6:
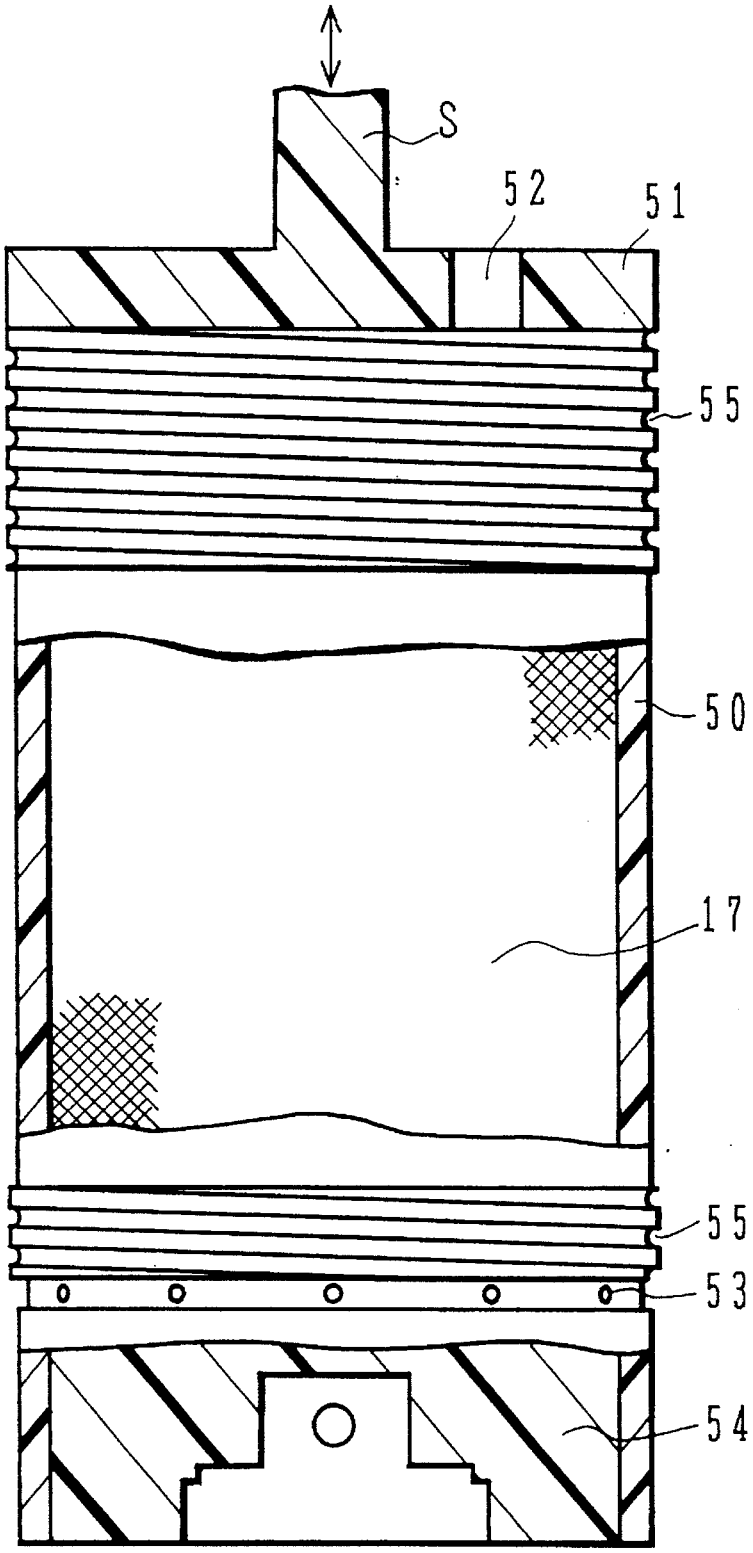
FIG. 6 is a cross sectional view showing an example of the structure of a first stage displacer of a refrigerator with a regenerator according to an embodiment of the present invention.

FIG. 6 shows an example of the structure of a first stage displacer having a spiral gas passage formed on the outer circumferential surface thereof. A tubular member 50 of a circular shape in section made of phenol resin containing cloth has an upper lid, and the lower end thereof is opened. A flange 51 having a diameter slightly smaller than that of the tubular member 50 is mounted on the upper surface of the upper lid of the tubular member 50. An opening 52 forming a gas passage is formed in the flange 51 and the upper led of the tubular member 50. A drive shaft S is mounted on the upper surface of the flange 51 to drive the tubular member 50 up and down as indicated by a double-headed arrow in FIG. 6.

A wire screen (not shown) is disposed in the tubular member 50, contacting the tower surface of the upper lid. Regenerating material such as a copper wire screen is filled in the tubular member 50 under the wire screen. Under the regenerating material 17, another wire screen (not shown) is disposed. Openings 53 forming a gas passage are formed in the side wall of the tubular member 50 at the height of the wire screen under the regenerating material 17.

A lid 54 made of phenol resin containing cloth is inserted in the bottom opening of the tubular member 50, and bonded thereto. The lid 54 is a blank lid, and hermetically seals the bottom opening of the tubular member 50. A recess is formed at the bottom of the lid 54 for mounting a coupling mechanism 36 which couples the second stage displacer shown in FIG. 3 or 4.

A spiral gas passage formed by a single spiral groove is formed on the outer circumferential surface of the tubular member 50 from the upper end to the openings 53 area.

The outer diameter of the tubular member 50 at the position lower than the openings 53 is slightly smaller than the outer diameter at the position higher than the openings 53. Therefore, a gap is formed at, the area lower than the openings 53 between the inner surface of the first stage cylinder and the outer circumferential surface of the tubular member 50. This gap is a gas passage communicating the inside of the tubular member 50 with the expansion space 21 shown in FIG. 2.

The diameter of the flange 51 is slightly smaller than the outer diameter of the tubular member 50 so that a gap is formed between the outer circumferential surface of the flange and the inner surface off the cylinder. This gap is a gas passage communicating the gas passage 55 with the upper space in the first stage cylinder 11 shown in FIG. 2.

For example, if the inner diameter of the first stage cylinder is 82 mm, then the outer diameter of the tubular member 50 is 82 mm, the inner diameter thereof is 72 mm, the outer diameter of the tubular member 50 at the area lower than the openings 53 and the outer diameter of the flange 51 are 81.5 mm, the length of the tubular member 50 in the axial direction is 150 mm, and the thickness of the flange 51 is 10 mm.

The cooling performance of a GM refrigerator having the structure of FIG. 2 and using first and second displacers both having a spiral gas passage was measured.

Figure 7:
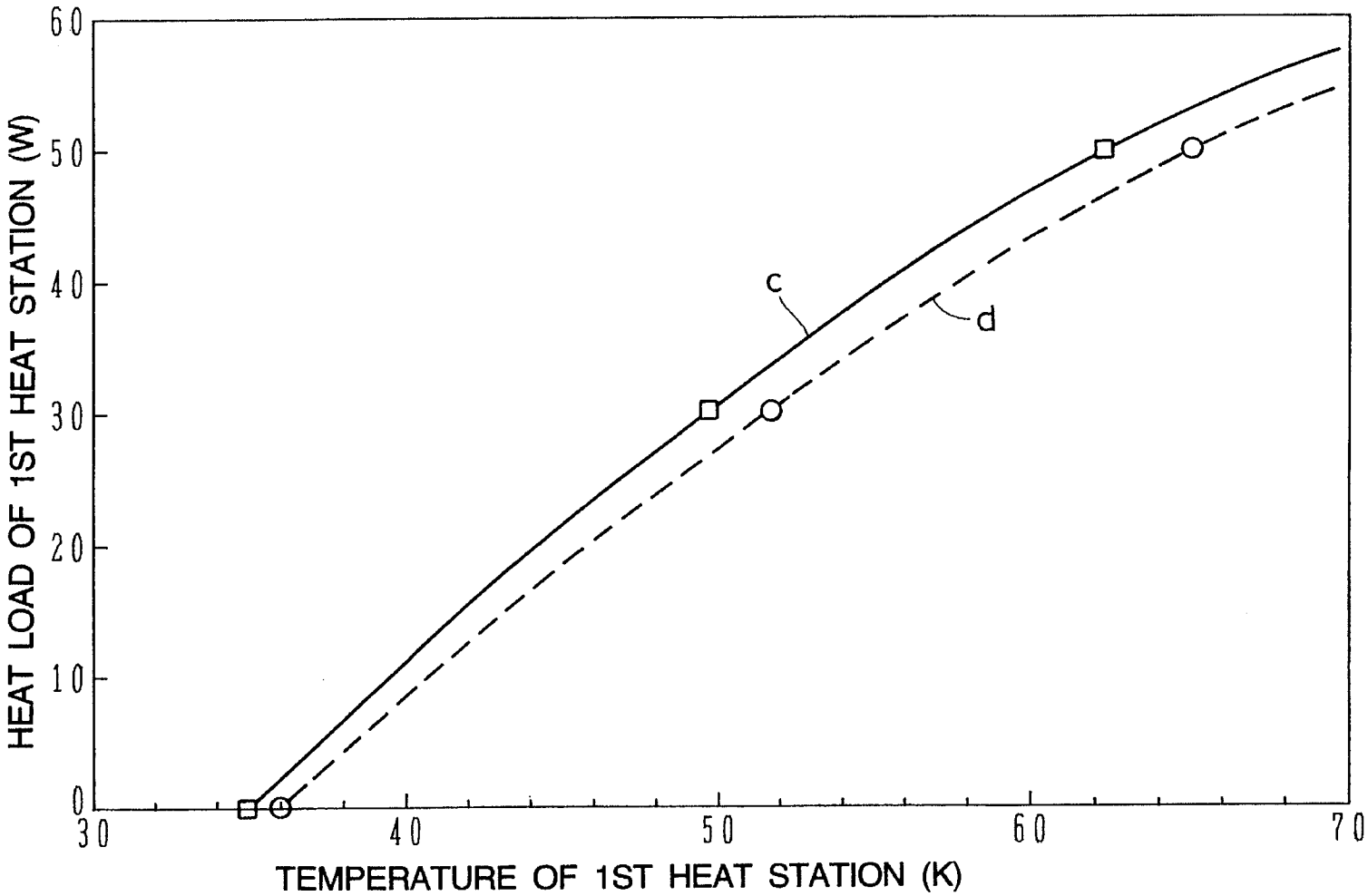
FIG. 7 is a graph showing the cooling performance of a refrigerator with a regenerator having a spiral groove formed on the first and second stage displacers, as compared to the cooling performance of a refrigerator with a regenerator having a spiral groove formed only on the second stage displacer.

FIG. 7 shows the cooled temperatures of the first heat stations of a GM refrigerator with only the second stage displacer being formed with a spiral groove and a GM refrigerator with both the first and second stage displacers being formed with a spiral groove. The abscissa represents a temperature of the first stage heat station in units of K, and the ordinate represents a heat load applied to the first stage heat station in units of W.

In FIG. 7 the curve c represents the GM refrigerator with both the first and second stage displacers being formed with a spiral groove, and the curve d represents the GM refrigerator with only the second displacer being formed with a spiral groove. The depth of the spiral groove of the first stage displacer was about 1.0 mm, the width thereof was about 2.0 mm, and the pitch thereof was about 4.0 mm.

As the regenerating material, a wire screen was used for the first stage displacer, and ErHoNi magnetic regenerating material of 580 g was used for the second stage displacer. The operating frequency of the displacer was 60 rpm, the stroke thereof was 30 mm, and a heat road of 10 W was applied to the second stage heat stations.

In both the cases of the curves c and d, as the heat load of the first stage heat station was increased, the temperature of the first stage heat station rose. With the same heat load, the curve c showed a temperature lower by about 5 to 15 K. than the curve d. That is to say, the first stage heat station could be cooled down to a lower temperature by forming a spiral groove on the surface of the first stage displacer. The cooling performance can therefore be improved by forming a spiral groove not only on the surface of the second stage displacer but also on the surface of the first stage displacer.

In the above embodiments, the regenerating material is filled in the displacer and the gas passage is formed within the displacer. The regenerating material may be disposed to the outside of the displacer.

Figure 8:
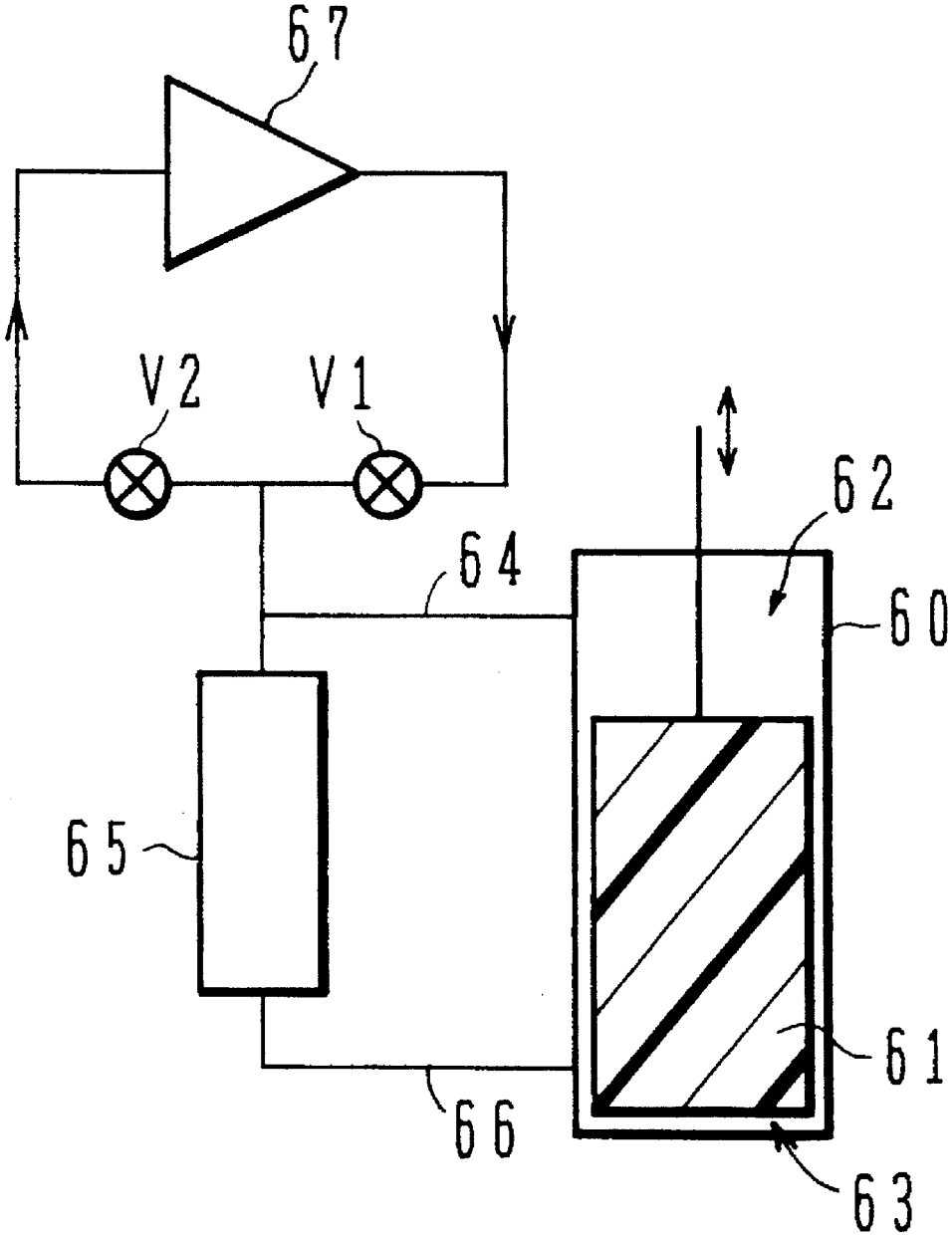
FIG. 8 is a schematic diagram showing the outline of the structure of a single stage type GM refrigerator having regenerating material disposed at the outside of a displacer.
Figure 9A:
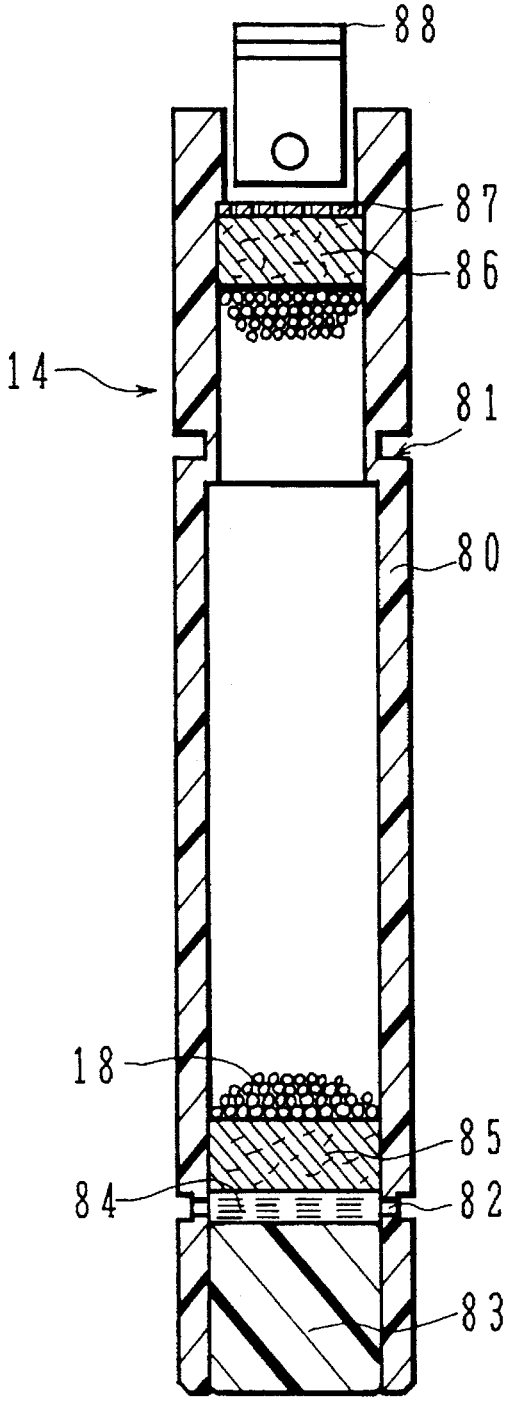
FIG. 9A is a cross sectional view of a conventional second stage displacer.
Figure 9B:
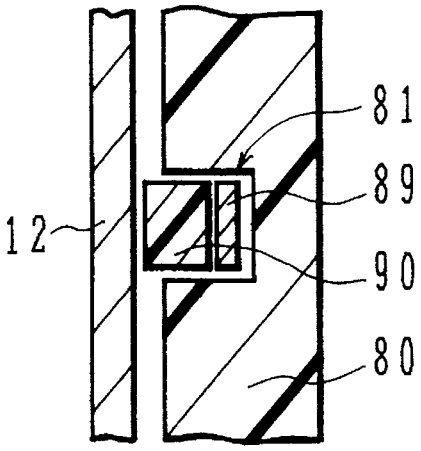
FIG. 9B is a cross sectional view showing a sealing mechanism of a conventional second stage displacer.

FIG. 8 is a schematic diagram showing a single stage type GM refrigerator having the regenerating material being disposed outside of the displacer. A displacer 61 is disposed in a cylinder 60, the displacer 61 being driven up and down in the direction indicated by a double-headed arrow in FIG. 8. The displacer 61 is off a cylindrical shape and made of, for example, phenol containing cloth having a low heat conductivity. An upper space 62 is formed in the cylinder 60 at the upper area of the displacer 61, and an expansion space 63 is formed in the cylinder 60 at the lower area of the displacer 61. FIG. 8 shows the displacer 61 moved down to the lowest position.

The upper space 62 and expansion space 63 in the cylinder 60 are communicated with each other via a pipe 64, a regenerator 65 filled with regenerating material, and a pipe 66. As the displacer 61 moves up and down, helium gas is supplied into, or recovered from, the lower expansion space 63, while heat-exchanging with the regenerator 65.

High pressure helium gas from a helium gas compressor 67 is also supplied to the upper space 62 of the cylinder 60 via a suction valve V1 and the pipe 64. The helium gas in the expansion space 63 is recovered back to the helium gas compressor 67 via the pipe 66, the regenerator 65, and an exhaust valve V2.

Also in the case of a refrigerator having the regenerating material disposed outside of the displacer, gas flowing through a gap between the inner surface of the cylinder 60 and the displacer 61 flows along a spiral groove formed on the outer circumferential surface off the displacer 61. Accordingly, effective heat exchange of gas with the cylinder and displacer is obtained providing the same effects as the case of the regenerating material filled in the displacer.

In the above embodiments a spiral gas passage is formed on the surface of a displacer. The shape of the gas passage is not limited to a spiral, but may take any other shape on condition that gas flowing through a gap between the cylinder and displacer is allowed to sufficiently heat-exchange with the surface off the gas passage. Other shapes of a gas passage will be described with reference to FIGS. 11A to 11H.

FIGS. 11A to 11H are schematic diagrams showing a groove pattern formed on the outer circumferential surface of a displacer, by developing the pattern in the circumferential direction. FIGS. 11A to 11H show only the features of a groove pattern shape, and are not limited with respect to a groove pitch, a groove inclination from the axial direction, and the like.

Figure 11A:
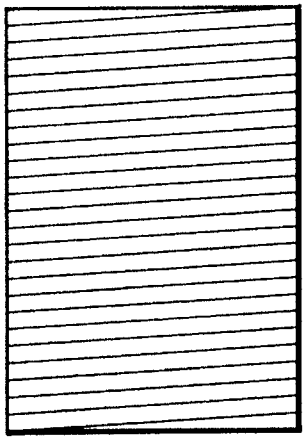
FIGS. 11A to 11H are schematic development diagrams showing examples of a groove pattern formed on the displacer surface of a refrigerator with a regenerator according to an embodiment of the present invention.

FIG. 11A shows a single spiral groove extending from the top to bottom end of the outer circumferential surface of a displacer, like those shown in FIGS. 3 and 4.

Figure 11B:
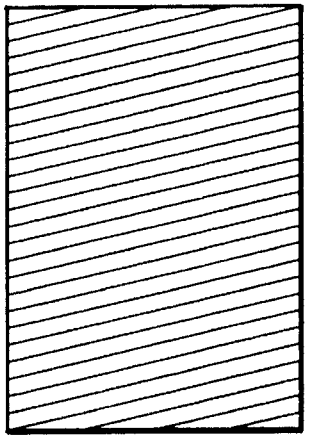

As shown in FIG. 11B, a plurality of spiral grooves may be formed. FIG. 11B shows four spiral grooves formed in parallel.

Figure 11C:
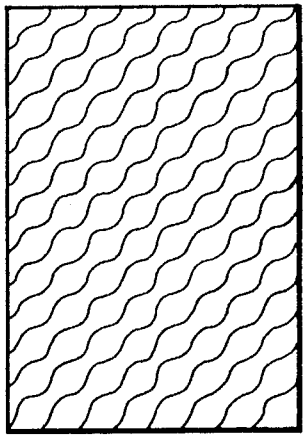
Figure 11D:
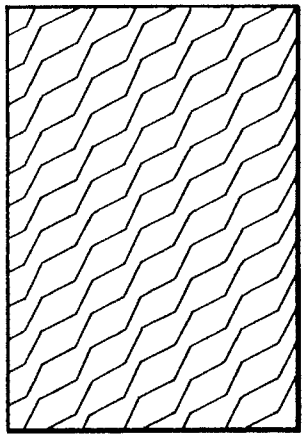
Figure 11E:
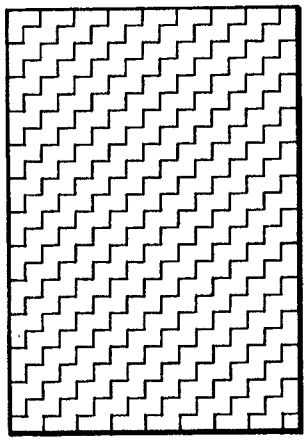
Figure 11F:
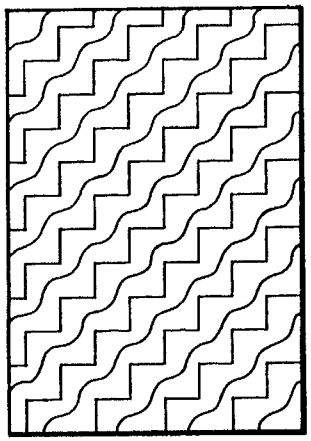

As shown in FIGS. 11C and 11D, a spiral groove may be a waved spiral groove or zigzagged spiral groove. As shown in FIG. 11E, a spiral groove may be a stepwise zigzag spiral groove formed by parallel and perpendicular segments relative to the axial direction of a displacer. As shown in FIG. 11F, a combination of a waved spiral groove and a zigzag spiral groove may be used.

Figure 11G:
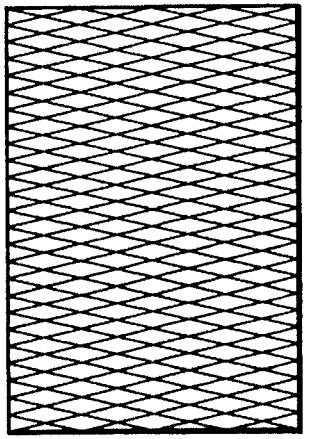

As shown in FIG. 11G, a combination of two or more spiral grooves having opposite rotation directions and intersecting with one another may be used.

Figure 11H:
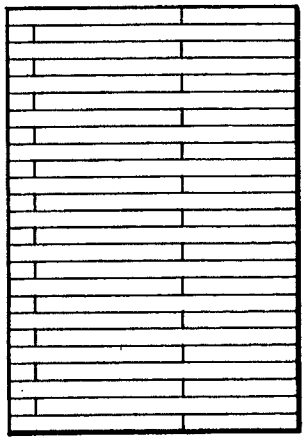

As shown in FIG. 11H, a plurality off circumferential grooves may be formed in the circumferential direction of the outer surface of a displacer, the adjacent circumferential grooves being communicated with each other by a vertical communication groove. In this case, it is preferable to form vertical communication grooves of two upper and lower circumferential grooves at different positions in order to elongate the gas passage as much as possible. It is also preferable to form vertical communication grooves in axial symmetry.

A groove or grooves of each groove pattern described above are formed at least partially in the direction slanted from the axial direction of a displacer. As a result, gas flows through a passage longer than a passage of gas flowing in parallel to the axial direction. It is therefore possible to obtain more efficient heal exchange of gas with the displacer and cylinder.

The cross section of the gas passage formed on the outer circumferential surface of a displacer may be a rectangle, a triangle, a circle, or other shapes.

In order to enhance the heat exchange efficiency of gas flowing through the gas passage formed on the outer circumferential surface of a displacer, regenerating material may be attached to the outer circumferential surface of a displacer or the inner surface of the gas passage. Regenerating material may by filled in the gas passage.

In the above embodiments, a groove pattern is formed on the outer circumferential surface of a displacer. A groove pattern may be formed on the inner circumferential surface of a cylinder to obtain the same effects. In this case, a groove pattern is formed on the inner circumferential surface of the cylinder, the groove pattern extending at least from one end to the other end in a circumferential area covered by the reciprocal motion of the displacer.

Figure 12:
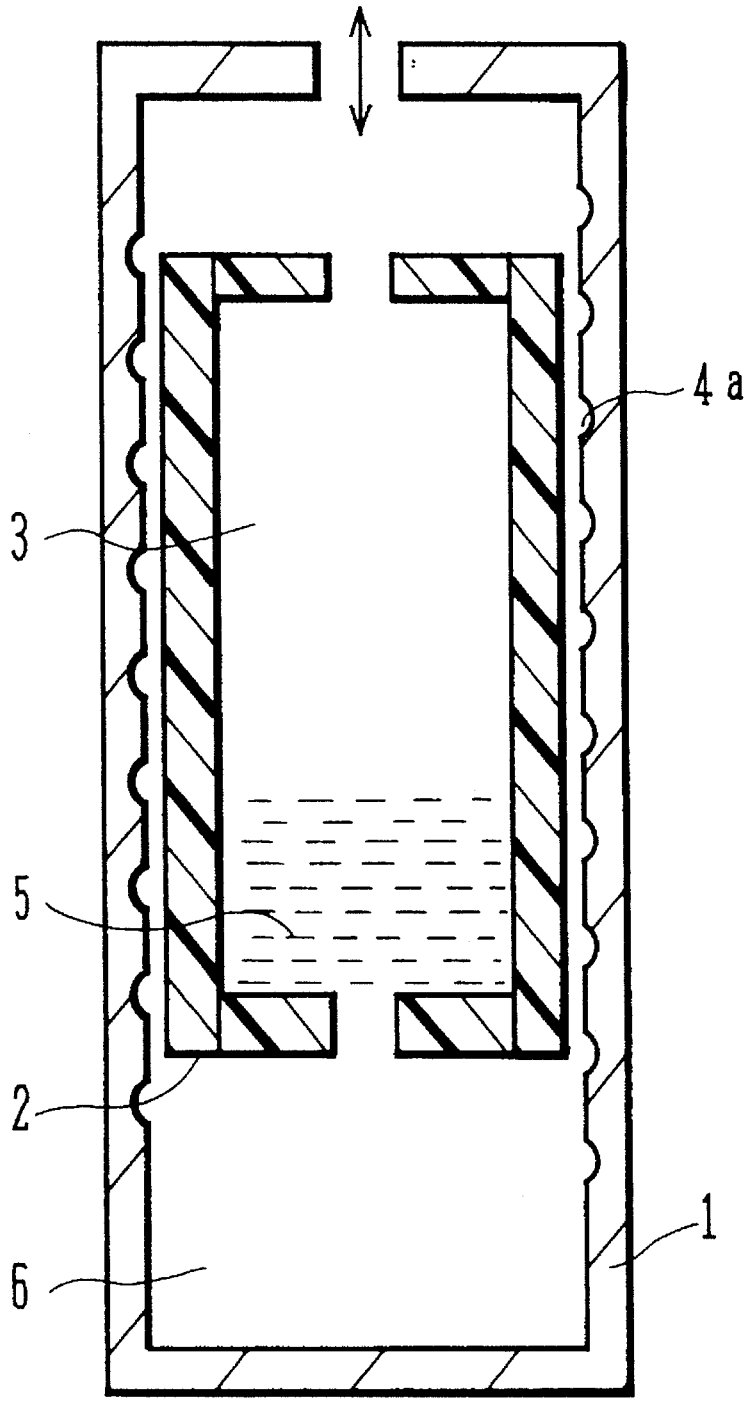
FIG. 12 is a cross sectional view showing another example of the fundamental structure of a refrigerator with a regenerator according to an embodiment of the present invention.

FIG. 12 shows the fundamental structure of a cylinder and a displacer in which a groove pattern is formed on the inner circumferential surface of the cylinder. Instead of the spiral gas passage 4 formed on the outer circumferential surface of the displacer 2 shown in FIG. 1, a spiral gas passage 4*a* is formed on the inner circumferential surface of a cylinder 1. The other structures are the same as FIG. 1. Not only a spiral groove pattern, but also various groove patterns shown in FIGS. 11A to 11H may be formed.

The present invention has been described in connection with the preferred embodiments. The invention is not limited only to the above embodiments. For example, the invention is applicable not only to a GM refrigerator but also to refrigerators using different regenerators, such as a Stirling refrigerator and a Solvay cycle refrigerator.

Although the structure using two stage displacers has been described, the invention is applicable to the structures using a single stage displacer or three or more stage displacers. The invention is applicable to other different types of refrigerators having a regenerator using a displacer at a low temperature. It is apparent to those skilled in the art that various modifications, improvements, combinations and the like can be made without departing from the scope of the appended claims.

We claim:

1. A refrigerator with a regenerator comprising:

at least one cylinder having an inner circumferential surface with a circular tube shape and a diameter, each said cylinder being made of a material having a low heat conductivity and a high hermetic sealing performance;

at least one displacer, each displacer having an outer circumferential surface with a circular tube shape having a diameter slightly smaller than the diameter of the inner circumferential surface of a respective said cylinder and extending in an axial direction thereof, said displacer being disposed in said cylinder to be reciprocally movable in an axial direction of said cylinder and forming an expansion space near one end of an inside of said cylinder;

a groove pattern formed on one of (i) the outer circumferential surface of each said displacer and (ii) the inner circumferential surface of the respective said cylinder, for forming an auxiliary gas passage for supplying gas into the expansion space of said cylinder and recovering the gas from the expansion space, said groove pattern including a groove at least partially formed along direction intersecting the axial direction of said displacer, said groove allowing a gas to flow therethrough from one end to an opposite end of the outer circumferential surface of said displacer to positively heat-exchange with said cylinder and said displacer;

a main gas passage for supplying a gas to the expansion space of each said cylinder and recovering the gas from the expansion space thereof;

a regenerating material disposed at least partially in each main gas passage;

a gas supplying and recovering means for supplying a gas having a periodically varying gas pressure to each expansion space through said groove pattern and through said main gas passage, and recovering the gas from the expansion space through said groove pattern and through said main gas passage, wherein each said displacer moves reciprocally in the axial direction of the respective said cylinder in accordance with pressure changes in the expansion space of the respective said cylinder, to cool the gas in the expansion space.

2. A refrigerator with a regenerator according to claim 1, wherein said groove pattern is a spiral groove pattern.

3. A refrigerator with a regenerator according to claim 2, wherein said groove pattern is a multiple spiral groove pattern having at least two spiral grooves disposed in parallel.

4. A refrigerator with a regenerator according to claim 1, wherein said groove pattern has a plurality of circumferential grooves formed in the circumferential direction and a plurality of coupling grooves each coupling two adjacent circumferential grooves of said plurality of circumferential grooves, wherein two coupling grooves formed at each said circumferential groove are formed at different positions in the circumferential direction.

5. A refrigerator with a regenerator according to claim 1, wherein there is a gap between the inner circumferential surface of said cylinder and the outer circumferential surface of said displacer, and said gap is 0.01 mm to 0.03 mm.

6. A refrigerator with a regenerator according to claim 1, wherein said at least one cylinder includes at least two cylinders, and said at least one displacer includes at least two displacers, each displacer disposed in a respective one of said at least two cylinders.

7. A refrigerator with a regenerator according to claim 6, wherein there is a gap between the inner circumferential surface of said cylinder and the outer circumferential surface of said displacer and said gap is 0.01 mm to 0.03 mm.

8. A refrigerator with a regenerator according to claim 1, wherein each said displacer has a hollow space therein, said regenerating material is filled in said hollow space, and said hollow space forms said main gas passage.

9. A refrigerator with a regenerator according to claim 8, wherein said grove pattern is a spiral groove pattern formed on said displacer.

10. A refrigerator with a regenerator according to claim 9, wherein said groove pattern is a multiple groove pattern having at least two spiral grooves formed on said displacer.

11. A refrigerator with a regenerator according to claim 8, wherein said groove pattern has a plurality of circumferential grooves formed on the outer circumferential surface of said displacer in the circumferential direction and a plurality of coupling grooves each coupling two adjacent circumferential grooves of said plurality of circumferential grooves, wherein two coupling grooves formed at each said circumferential groove are formed at different positions in the circumferential direction.

12. A refrigerator with a regenerator according to claim 1, further comprising:

a plurality of other cylinders interconnected with each other, each having an inner circumferential surface with a circular tube shape and a diameter, each said other cylinder being made of a material having a low heat conductivity and a high hermetic sealing performance, an inner space being defined by said at least one cylinder and by each said other cylinder and the inner space of one of said other cylinders communicating with the inner space of said at least one cylinder;

a plurality of other displacers, each having an outer circumferential surface with a circular tube shape having a diameter slightly smaller than the diameter of the inner circumferential surface of a respective said other cylinder, each said other displacer being disposed in a respective said other cylinder to be reciprocally movable in an axial direction of each said other cylinder and forming an expansion space near one end of an inside of said other cylinder;

a plurality of other main gas passages, each for supplying a gas to the expansion space of each said other cylinder and recovering the gas from the expansion space; and a plurality of other regenerating materials, each disposed at least partially in each said other main gas passage.

13. A refrigerator with a regenerator according to claim 12, wherein another groove pattern is formed on at least one of (i) the outer circumferential surface of at least one other said displacer and (ii) the inner circumferential surface of at least one other said cylinder, for forming another auxiliary gas passage for supplying gas into the expansion space formed near the inside of said other cylinder and recovering the gas from the expansion space, said other groove pattern including a groove at least partially formed along a direction intersecting the axial direction of said other displacer, said groove allowing a gas to flow therethrough from one end to an opposite end of the outer circumferential surface of said other displacer to positively heat-exchange with said other cylinder and said other displacer.

14. A refrigerator with a regenerator according to claim 13, wherein said other groove pattern is formed on at least ones of all the inner circumferential surfaces of said plurality of other cylinders and all the outer circumferential surfaces of said plurality of other displacers.

15. A refrigerator with a regenerator according to claim 12, wherein each of said plurality of other displacers has a hollow space therein, each said other regenerating material is filled in said hollow space, and said hollow space forms each of said plurality of other main gas passages.

16. A refrigerator with a regenerator according to claim 15, wherein another groove pattern is formed on at least one of (i) the outer circumferential surface of at least one other said displacer and (ii) the inner circumferential surface of at least one other said cylinder, for forming another auxiliary gas passage for supplying gas into the expansion space formed near the inside of said other cylinder and recovering the gas from the expansion space, said other groove pattern including a groove at least partially formed along a direction intersecting the axial direction of said other displacer, said groove allowing a gas to flow therethrough from one end to an opposite end of the outer circumferential surface of said other displacer to positively heat-exchange with said other cylinder and said other displacer.

17. A refrigerator with a regenerator according to claim 16, wherein said other groove pattern is formed on at least ones of all the inner circumferential surfaces of said plurality of other cylinders and all the outer circumferential surfaces of said plurality of other displacers.

18. A refrigerator with a regenerator comprising:

at least one cylinder having an inner circumferential surface with a circular tube shape and a diameter, said cylinder being made of a material having a low heat conductivity and a high hermetic sealing performance;

at least one displacer, each displacer having a main gas passage therethrough and an outer circumferential surface with a circular tube shape having a diameter slightly smaller than the diameter of the inner circumferential surface of a respective said cylinder and extending in an axial direction thereof, said displacer being disposed in said cylinder to be reciprocally movable in an axial direction of said cylinder and forming an expansion space near one end of an inside of said cylinder, with a higher temperature space being near an opposite end of the inside of said cylinder, said main gas passage connecting the expansion space and the higher temperature space;

a regenerating material disposed at least partially in each main gas passage;

a groove pattern formed on one of (i) the outer circumferential surface of each said displacer and (ii) the inner circumferential surface of the respective said cylinder, said groove pattern including a groove at least partially formed along a direction intersecting the axial direction of said displacer, said groove allowing a gas to flow therethrough from the expansion space to the higher temperature space, to positively heat-exchange with said cylinder and said displacer; and a gas supplying and recovering means for supplying a gas having a periodically varying gas pressure to each higher temperature space, and recovering the gas from the higher temperature space, wherein each said displacer moves reciprocally in the axial direction of the respective said cylinder in accordance with pressure changes in the expansion space and the higher temperature space to cool the gas in the expansion space.

19. A refrigerator with a regenerator according to claim 18, wherein said groove pattern is a spiral groove pattern.

20. A refrigerator with a regenerator according to claim 19, wherein said groove pattern is a multiple spiral groove pattern having at least two spiral grooves disposed in parallel.

21. A refrigerator with a regenerator according to claim 18, wherein said groove pattern has a plurality of circumferential grooves formed in the circumferential direction and a plurality of coupling grooves each coupling two adjacent circumferential grooves of said plurality of circumferential grooves, wherein two coupling grooves formed at each said circumferential groove are formed at different positions in the circumferential direction.

22. A refrigerator with a regenerator according to claim 18, wherein there is a gap between the inner circumferential surface of said cylinder and the outer circumferential surface of said displacer, and said gap is 0.01 mm to 0.03 mm.

23. A refrigerator with a regenerator according to claim 18, wherein said at least one cylinder includes at least two cylinders, and said at least one displacer includes at least two displacers, each displacer disposed in a respective one of said at least two cylinders.

24. A refrigerator with a regenerator according to claim 23, wherein there is a gap between the inner circumferential surface of said cylinder and the outer circumferential surface of said displacer, and said gap is 0.01 mm to 0.03 mm.

25. A refrigerator with a regenerator according to claim 18, further comprising:

a plurality of other cylinders interconnected with each other, each having an inner circumferential surface with a circular tube shape and a diameter, each said other cylinder being made of a material having a low heat conductivity and a high hermetic sealing performance, an inner space being defined by said at least one cylinder and by each said other cylinder and the inner space of one of said other cylinders communicating with the inner space of said at least one cylinder;

a plurality of other displacers, each having an outer circumferential surface with a circular tube shape having a diameter slightly smaller than the diameter of the inner circumferential surface of a respective said other cylinder, each said other displacer being disposed in a respective said other cylinder to be reciprocally movable in an axial direction of each said other cylinder and forming an expansion space near one end of an inside of said other cylinder;

a plurality of other main gas passages, each for supplying a gas to the expansion space of each said other cylinder and recovering the gas from the expansion space; and a plurality of other regenerating materials, each disposed at least partially in each said other main gas passage.

26. A refrigerator with a regenerator according to claim 25, wherein another groove pattern is formed on at least one of (i) the outer circumferential surface of at least one other said displacer and (ii) the inner circumferential surface of at least one other said cylinder, for forming another auxiliary gas passage for supplying gas into the expansion space formed near the inside of said other cylinder and recovering the gas from the expansion space, said other groove pattern including a groove at least partially formed along a direction intersecting the axial direction of said other displacer, said groove allowing a gas to flow therethrough from one end to an opposite end of the outer circumferential surface of said other displacer to positively heat-exchange with said other cylinder and said other displacer.

27. A refrigerator with a regenerator according to claim 26, wherein said other groove pattern is formed on at least ones of all the inner circumferential surfaces of said plurality of other cylinders and all the outer circumferential surfaces of said plurality of other displacers.

28. A refrigerator with a regenerator according to claim 25, wherein each of said plurality of other displacers has a hollow space therein, each said other regenerating material is filled in said hollow space, and said hollow space forms each of said plurality of other main gas passages.

29. A refrigerator with a regenerator according to claim 28, wherein another groove pattern is formed on at least one of (i) the outer circumferential surface of at least one other said displacer and (ii) the inner circumferential surface of at least one other said cylinder, for forming another auxiliary gas passage for supplying gas into the expansion space formed near the inside of said other cylinder and recovering the gas from the expansion space, said other groove pattern including a groove at least partially formed along a direction intersecting the axial direction of said other displacer, said groove allowing a gas to flow therethrough from one end to an opposite end of the outer circumferential surface of said other displacer to positively heat-exchange with said other cylinder and said other displacer.

30. A refrigerator with a regenerator according to claim 29, wherein said other groove pattern is formed on at least ones of all the inner circumferential surfaces of said plurality of other cylinders and all the outer circumferential surfaces of said plurality of other displacers.

31. A refrigerator with a regenerator comprising:

at least one cylinder having an inner circumferential surface with a circular tube shape and a diameter, said cylinder being made of a material having a low heat conductivity and a high hermetic sealing performance;

at least one displacer, each displacer having a main gas passage therethrough and an outer circumferential surface with a circular tube shape having a diameter slightly smaller than the diameter of the inner circumferential surface of a respective said cylinder and extending in an axial direction thereof, said displacer being disposed in said cylinder to be reciprocally movable in an axial direction of said cylinder and forming an expansion space near one end of an inside of said cylinder, with a higher temperature space being near an opposite end of the inside of said cylinder, said main gas passage connecting the expansion space and the higher temperature space, each said displacer including a groove pattern on the outer circumferential surface thereof, said groove pattern including a groove at least partially formed along a direction intersecting the axial direction of said displacer, said groove allowing a gas to flow therethrough from the expansion space to the higher temperature space, to positively heat-exchange with said cylinder and said displacer;

a regenerating material disposed at least partially in each main gas passage; and a gas supplying and recovering means for supplying a gas having a periodically varying gas pressure to each higher temperature space, and recovering the gas from the higher temperature space, wherein each said displacer moves reciprocally in the axial direction of the respective said cylinder in accordance with pressure changes in the expansion space and the higher temperature space to cool the gas in the expansion space.

32. A refrigerator with a regenerator according to claim 31, wherein said groove pattern is a spiral groove pattern.

* * * * *